United States Patent [19]

Schumacher et al.

[11] Patent Number: 4,916,361

[45] Date of Patent: Apr. 10, 1990

[54] PLASMA WAVE TUBE

[75] Inventors: Robert W. Schumacher, Canoga Park; Joseph Santoru, Valencia, both of Calif.

[73] Assignee: Hughes Aircraft Company, Los Angeles, Calif.

[21] Appl. No.: 181,340

[22] Filed: Apr. 14, 1988

[51] Int. Cl.[4] ..... H01J 7/24; H05B 31/26

[52] U.S. Cl. ..... 315/111.21; 313/231.31

[58] Field of Search ..... 315/111.21, 111.41, 315/111.81, 111.91, 4, 5, 39; 313/231.31, 231.41, 362.1, 156, 161; 250/423 R, 427 R

[56] References Cited

U.S. PATENT DOCUMENTS

| | | | |
|---|---|---|---|
| 2,706,782 | 4/1955 | Mumford | 315/39 |
| 3,258,633 | 6/1966 | Swartz | 315/111.21 X |
| 3,274,507 | 9/1966 | Weimer et al. | 330/41 |
| 3,313,979 | 4/1967 | Landauer | 315/39 |
| 3,508,268 | 4/1970 | Forman | 343/701 |
| 3,566,185 | 2/1971 | Gaum | 315/111.91 |
| 3,831,052 | 8/1974 | Knechtli | 313/187 |
| 4,344,019 | 8/1982 | Gaum et al. | 315/111.81 |

FOREIGN PATENT DOCUMENTS 1011449 12/1965 United Kingdom .

OTHER PUBLICATIONS

Schumacher et al., "Sealing of Milimeter-Wave . . . Plasma-Filled Waveguide", 1987 IEEE Inter. Conf. on Plasma Science, Jun. 1-3, 1987, p. 41.

Schumacher et al., "Milimeter-Wave Generation Via Plasma Three-Wave Mixing", 1986 IEEE Inter. Conf. on Plasma Science, May 19-21, 1986, p. 68.

Eidson, "Coupling and Fast Waves on Electron beam--plasma systems", Proceeding of the Natural Electronic Conference, vol. XX, Oct. 19-21, 1964, p. 84-87.

Igor Alexeff et al., "Millimeter Microwave Emission from a Maser by use of Plasma-Produced Electrons Orbiting a Positively Charged Wire", Physical Review Letters, vol. 45, No. 5, pp. 351-354, Aug. 4, 1980.

John Backus, "Studies of Cold Cathode Discharges in Magnetic Fields", Journal of Applied Physics, vol. 30. No. 12, pp. 1866-1869, Dec. 1959.

G. W. McClure, "Low-Pressure Glow Discharge", Applied Physics Letters, vol. 2, No. 12, pp. 233-234, Jun. 15, 1963.

D. Bohm et al., "Theory of Plasma Oscillations. A. Origin of Medium-Like Behavior", Physical Review, vol. 75, No. 12, pp. 1851-1864, Jun. 15, 1949.

A. V. Haeff, "Space-Charge Wave Amplification Effects", Physics Rev. 74, pp. 1532-1533, 1948.

M. A. Lampert, "Plasma Oscillations at Extremely High Frequencies", Journal of Applied Physics, vol. 27, No. 1, pp. 5-11, Jan. 1956.

A. D. Piliya, "Wave Conversion in an Inhomogeneous Plasma", Soviet Physics-Technical Physics, vol. 11, No. 5, pp. 609-614, Nov. 1966.

F. L. Hinton, "Collisionless Absorption and Emission of Electromagnetic Waves by a Bounded Plasma", The Physics of Fluids, vol. 10, No. 11, pp. 2408-2416, Nov. 1967.

T. J. M. Boyd, "Emission of Radio Noise by Plasmas", The Physics of Fluids, vol. 7, No. 1, pp. 59-63, Jan. 1964.

(List continued on next page.)

*Primary Examiner*—Eugene R. LaRoche
*Assistant Examiner*—Seung Ham
*Attorney, Agent, or Firm*—V. D. Duraiswamy; P. M. Coble; W. K. Denson-Low

[57] ABSTRACT

A plasma wave tube is described in which a pair of counterpropagating electron beams are injected into a waveguide housing in which a plasma is formed, prefeferably by an array of fine wire anodes. The electron beams couple with the plasma to produce electron plasma waves, which radiate electromagnetic energy for beam voltages and currents above established threshold levels. A rapid control over output frequency is achieved by controlling the plasma discharge current, while the output power can be controlled by controlling the voltage and/or current levels of the electron beams.

26 Claims, 8 Drawing Sheets

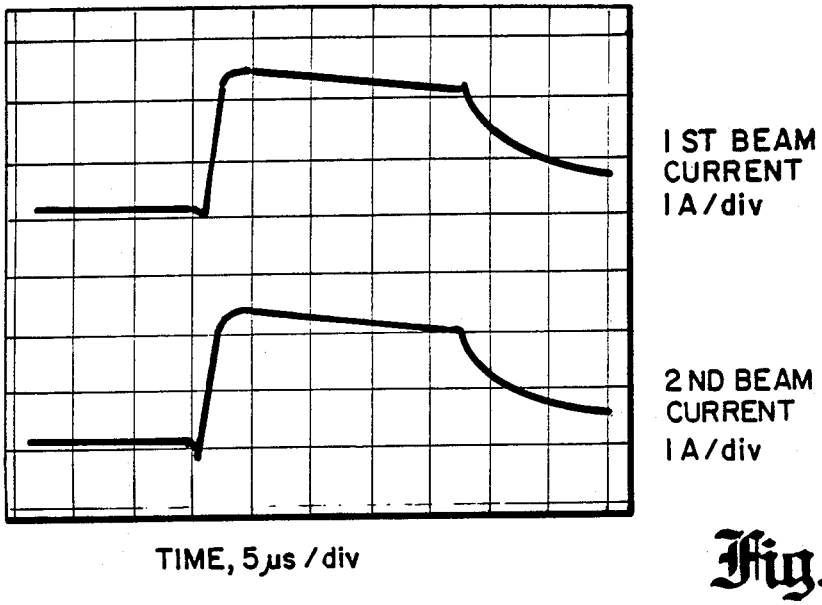
Fig.4.a.
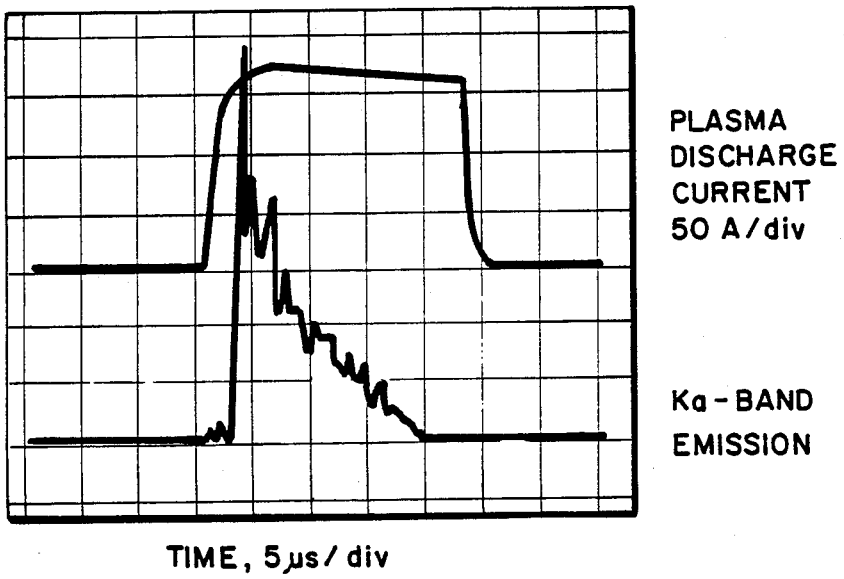
Fig.4.b.

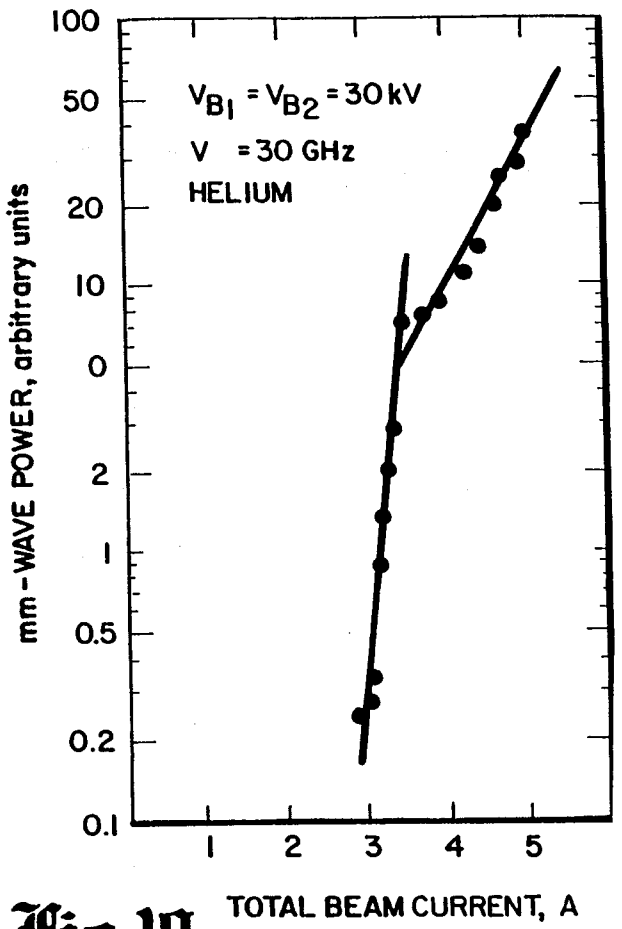
Fig. III.
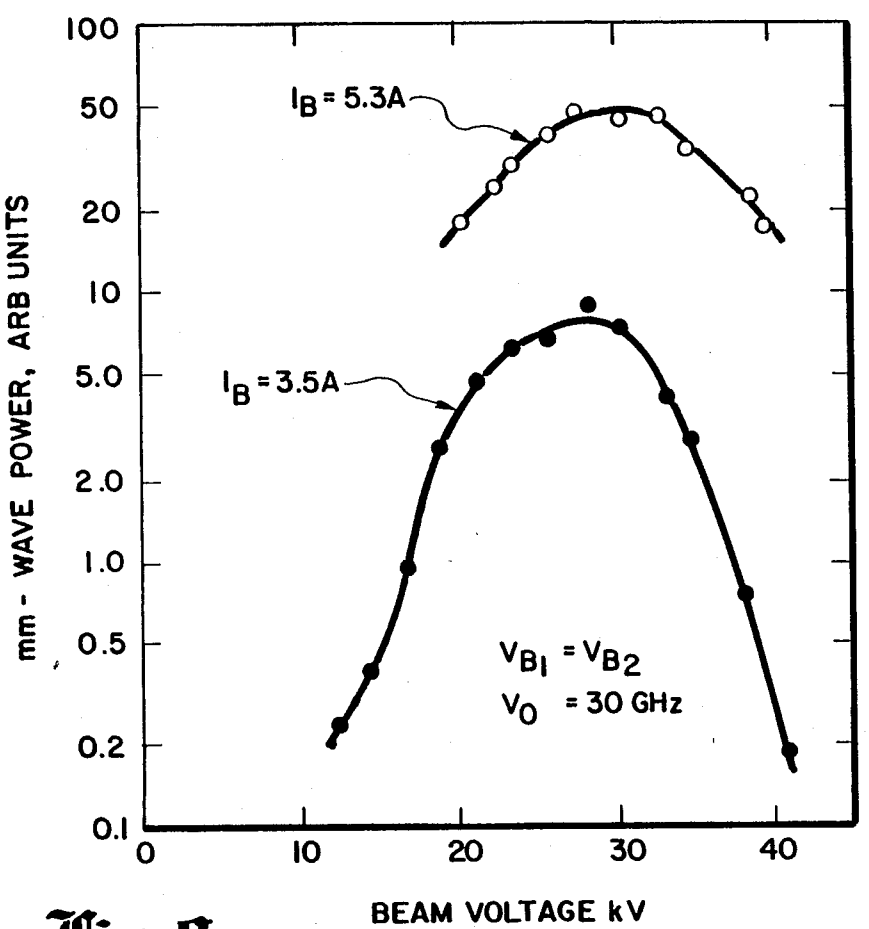
Fig. II.

PLASMA WAVE TUBE

BACKGROUND OF THE INVENTION

Government Riqhts in Invention

This invention was made with U.S. Government Support under Contract No. F49620-85-C-0059, awarded by the Department of the Air Force. The U.S. Government has certain rights in this invention.

FIELD OF THE INVENTION

This invention relates to systems for generating and propagating microwave to mm-wave electromagnetic radiation along a waveguide as a result of the nonlinear coupling of electron beam-driven electrostatic plasma waves within the waveguide.

DESCRIPTION OF THE RELATED ART

It would be highly desirable to be able to generate broadband, medium power (kilowatts) microwave to mm-wave radiation with a rapid frequency hopping and chirping capability over multiple octaves in frequency in a simple, low-cost and compact package. Keeping a device of this type light in weight would also be very important, since it would have various applications as a compact broadband transmitting mechanism for electronic warfare jamming applications. However, no devices have heretofore been developed that are capable of providing these functions in a satisfactory manner, and with high efficiency.

Various devices exist which might be considered for this application, but there are significant limitations to each. These include slow-wave devices such as travelling wave tubes, backward wave oscillators, magnetrons and Klystrons; fast-wave devices such as gyrotrons and free-electron lasers; and solid-state devices such as Gunn and IMPATT oscillators. The slow-wave devices produce too little mm-wave power, the fast-wave devices require very high voltages, high magnetic fields, and cannot be packaged compactly, while the solid-state devices provide narrow bandwidth and low power.

Another type of device, described in I. Alexeff and F. Dyer, Phys. Rev. Lett. 45, 351 (1980), is designated the orbitron maser. According to the authors, electrons are emitted from the inner surface of a cylinder by glow discharge, and are trapped in orbits about a thin wire which runs down the axis of a cylinder and has a positive voltage charge relative to the cylinder. The electrons drive a negative mass instability, which results in electron bunching. This in turn produces a space charge wave which couples to an electromagnetic waveguide mode. However, the orbitron maser requires highly fragile wire electrodes at mm-wave frequencies, and has too low an efficiency (in the order of about $10^{-6}$) for practical applications.

The injection of a powerful electron beam into a high-density plasma has previously been found to excite an electron plasma wave with a phase velocity less than the beam speed. The electron plasma wave is an electrostatic wave which oscillates at a frequency determined by the plasma density. The possibility of using the beam-plasma interaction to generate electromagnetic radiation was recognized when excitation of plasma waves by the two-stream instability was first discovered. However, the problem of coupling the RF energy out of the plasma prevented the development of practical sources or amplifiers based on this interaction. The coupling problem has its root in the fact that the RF energy is stored in an electron plasma wave which is purely electrostatic and trapped in the plasma. If the plasma is uniform, the electric field of each half-cycle of the wave accelerates the same number of electrons with alternating phase, so that no net source current is driven which can couple to an electromagnetic wave (electric field and density fluctuations are 90° out of phase).

More recently, however, experimental observations and advancements in plasma theory have shown that physical mechanisms exist which permit the conversion of electrostatic waves to electromagnetic waves inside the plasma, and the direct radiation of these waves with the plasma acting as an antenna. These processes require that the electron plasma waves interact with a density gradient or other plasma waves in a nonlinear wave-wave interaction in order to conserve momentum. The latter interaction is often called three-wave mixing, since it involves the coupling of two electrostatic plasma waves to generate an electromagnetic wave. Such mechanisms were originally proposed to explain bursts of radio emission from solar flares. Evidence of plasma radiation due to these processes has been observed in the laboratory. However, no way to exploit this phenomenon in a practical device that extends to the mm-wave range, with a practical efficiency in excess of $10^{-4}$, has heretofore been devised.

A related patent application entitled "Plasma Wave Tube and Method" was filed concurrently with the present application by Robert W. Schumacher, one of the present inventors, and assigned to Hughes Aircraft Company, the assignee of the present invention. This related application describes a plasma wave tube and associated operating method which solve many of the problems of prior devices. A pair of cold-cathode electron beam generators are used to discharge counter-propagating electron beams into an ionizable gas within a waveguide housing. A voltage within the approximate range of 4–20 kV relative to the waveguide housing is applied to the cathodes to produce electron beams with current densities of at least about 1 amp/cm$^2$. The beams form a plasma within the gas and couple with the plasma to produce electron plasma waves, which are nonlinearly coupled to radiate electromagnetic energy in the microwave to mm-wave region. A magnetic field is established within the waveguide between the cathodes to confine the plasma, and to control the beam discharge impedance. The gas pressure is held within the approximate range of 1–100 mTorr, preferably about 10–30 mTorr, to damp plasma instabilities and sustain the beam voltages, while the magnetic field is within the approximate range of 100–500 Gauss. A very rapid frequency slewing or chirping is achieved with a relatively high magnetic field that reduces the discharge impedance to the lower end of the permissible range. Frequency-stabilized operation is achieved with a lower magnetic field that increases the discharge impedance so that the beam current changes very slowly with time. However, the efficiency of this device is less than optimum.

Related abstracts have also been published by Robert W. Schumacher, one of the present applicants, "Millimeter-Wave Generation Via Plasma Three-Wave Mixing", in connection with the 27th annual meeting of the Division of Plasma Physics, Nov. 4–8, 1985, and by inventors Robert W. Schumacher and Joseph Santoru, "Millimeter-Wave Generation Via Plasma Three-Wave Mixing", in connection with the 28th annual meeting of the Division of Plasma Physics, Nov. 3–7, 1986. These abstracts together discuss microwave generation via plasma three-wave mixing. The approach described in the abstracts involves the employment of a circular waveguide loaded with a quiescent, high-density plasma. High energy electron beams, less than or equal to 90 kV, were injected into the waveguide from opposite ends to excite counterstreaming electrostatic plasma waves. When energy and momentum conservation conditions were satisfied, the electrostatic plasma waves nonlinearly coupled to an electromagnetic wave waveguide mode at twice the plasma frequency. The plasma frequency scaling was observed from 7 to 60 GHz as the waveguide-discharge current was varied from 15 to 800 amps. The peak electromagnetic wave power (0.1 to 8 kW) increased nonlinearly with beam current, and the power envelope was strongly modulated in a random-burst manner.

SUMMARY OF THE INVENTION

In view of the above limitations, the present invention seeks to provide an apparatus for generating waveguide electromagnetic radiation in the microwave to mm-wave range in a simple, low-cost, lightweight and compact package, and with the capability of rapid frequency hopping and chirping.

In the improved plasma wave tube, electron beams and a waveguide plasma are separately generated to enable optimum control of frequency and power. No magnetic fields are used, thus simplifying the tube and eliminating the volume and weight of permanent or electro-magnets. The plasma in the waveguide is generated by a cold-cathode discharge which is struck between the waveguide, which serves as the cathode electrode, and an array of fine-wire anodes located inside the waveguide structure. Counter-propagating beams are passed through the plasma, which is generated in a gas which fills the waveguide at a pressure of about 1–100 mTorr. The electron beams are generated by cold-cathode, secondary electron-emission guns. Electron emission from the cold-cathode surfaces is stimulated by bombarding the surface with high energy ions which are accelerated across the electron gun high-voltage gap. These ions may be supplied by the waveguide plasma itself or, in the preferred embodiment, separate wire-anode discharge chambers are positioned in front of each electron gun cathode to supply an independently controllable source of ions, and thus enable variation of the electron beam current independent of the plasma density inside the waveguide.

Frequency variation is achieved by varying the plasma density within the waveguide housing via the wire-anode discharge current, independent of the electron beam generators. The power of the emitted electromagnetic radiation can be controlled by controlling the voltage and/or current levels of the electron beams.

These and other features and advantages of the invention will be apparent to those skilled in the art from the following detailed description of preferred embodiments, taken together with the accompanying drawings, in which:

DESCRIPTION OF THE DRAWINGS

FIG. 3 is a combined sectional view and electrical schematic of a preferred embodiment of a plasma wave tube;

FIGS. 4(*a*) and 4(*b*) are oscillograms of the electron beam currents and of the plasma discharge current and Ka frequency-band emission, respectively, illustrating the dependence of the plasma wave tube operation upon beam currents;

FIG. 9 is a graph illustrating the dependence of output power upon the electron beam voltage; and FIG. 10 is a graph illustrating the dependence of output power upon the electron beam current.

DETAILED DESCRIPTION OF PREFERRED EMBODIMENTS

Figure 1:
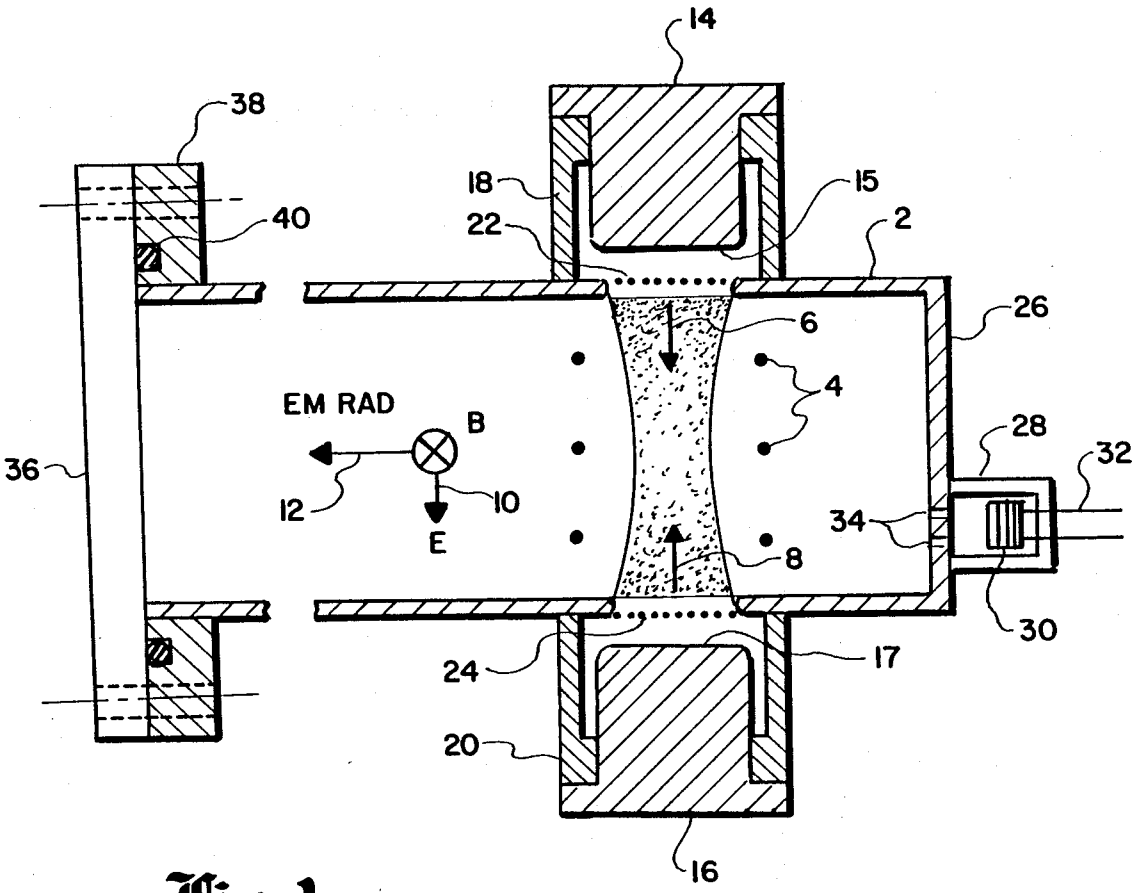
FIG. 1 is a sectional view of a plasma wave tube constructed in accordance with the invention.
Figure 2:
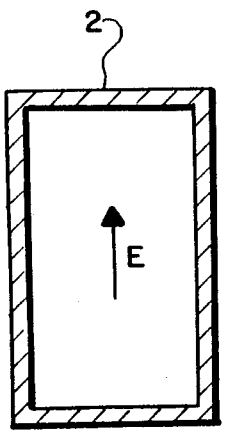
FIG. 2 is a sectional view showing the rectangular waveguide configuration of the plasma wave tube of FIG. 1.
Figure 1:
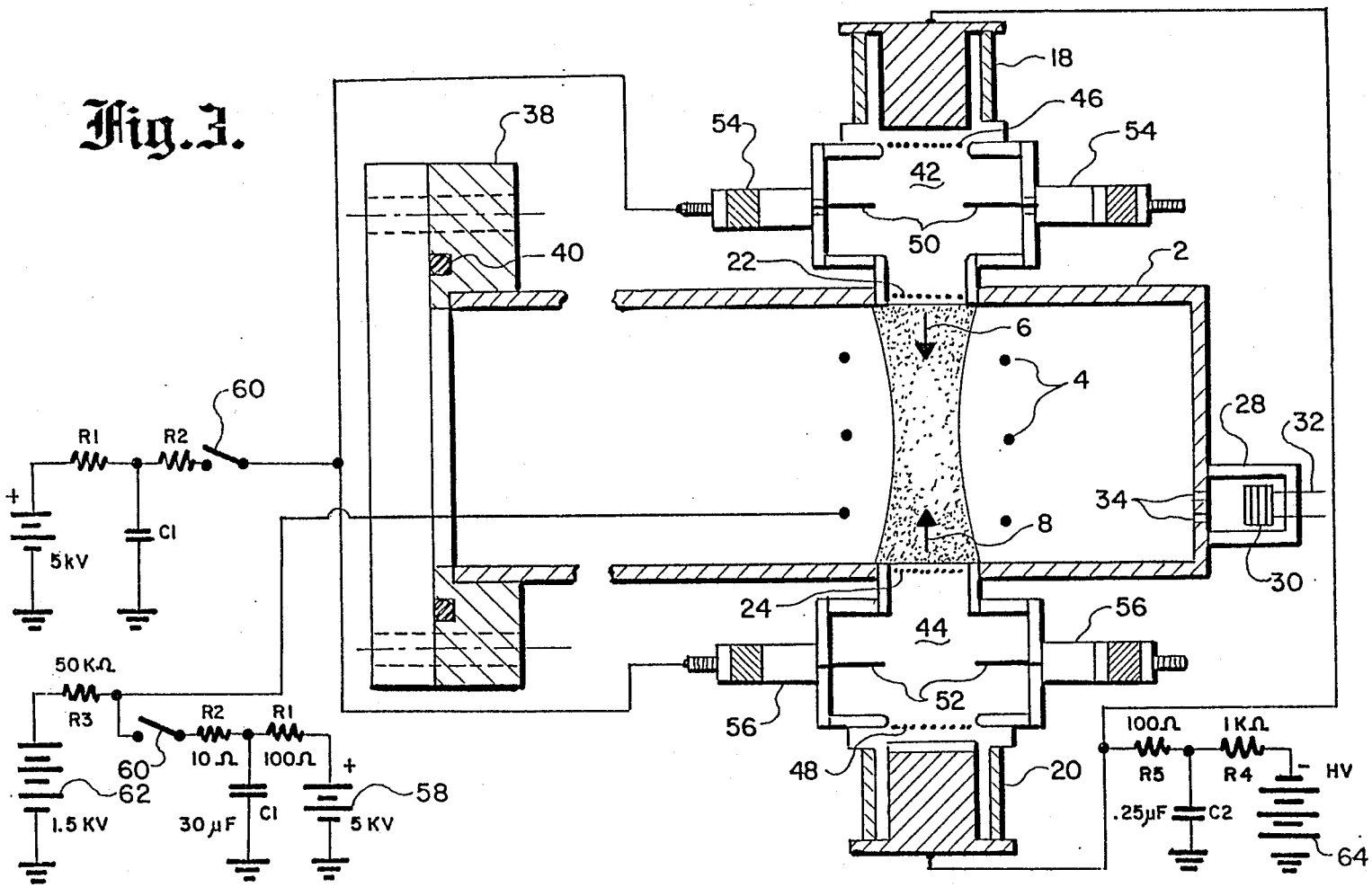

One embodiment of the invention is illustrated in FIG. 1. The basic technique used in the invention is to ionize a hydrogen or noble gas within a waveguide housing 2, preferably by means of a wire-ion-plasma (WIP) discharge to an array of fine-wire anodes 4, and to inject a pair of counterpropagating electron beams 6, 8 into the resulting plasma confined within waveguide 2. Plasma is generated within the waveguide by a cold-cathode discharge struck between the waveguide 2, which serves as the cathode electrode for this purpose, and the fine-wire anodes 4. With the proper conditions, the two electron beams cross-couple with the plasma to excite a pair of anti-parallel electron plasma waves, which are electrostatic waves that oscillate at a frequency determined by the plasma density. Since the wavenumbers of the two electron plasma waves are found to match, the plasma electrons will be bunched in phase and a net nonlinear plasma current density will be generated. As a consequence of waveenergy conservation, this current oscillates at twice the plasma frequency. The oscillating current radiates an electromagnetic wave, with the electric field vector 10 polarized along the beam direction and the electromagnetic propagation direction 12 generally transverse to the beams.

Cold-cathode electron guns are used to generate the beams. This has been found to eliminate various problems associated with conventional thermionic hot cathode devices, such as the requirement of a heater for the accompanying temperatures of about 1000° C., the requirement of a very high vacuum, and an incompatibility with most gases and plasma discharges. The preferred WIP discharge technique is described in U.S. Pat. No. 4,025,818, "Wire Ion Plasma Electron Gun", to Robert P. Giguere et al. and assigned to Hughes Aircraft Company, the assignee of the present invention. The generation of a high density plasma by a wire-anode discharge is described in an article by G. W. McClure, "Low-Pressure, Low Discharge", *Applied Physics Letters*, Vol. 2, No. 12, page 233 (1963).

Cold-cathodes 14 and 16 are inserted into internal chambers within ceramic insulating bushings 18 and 20, respectively, which in turn are mounted in alignment with each other on opposite faces of waveguide housing 2. Plasma within the waveguide can flow into the cold-cathode chambers through grids 22 and 24, respectively. Electron emission from the inner cold-cathode surfaces 15 and 17 is stimulated by bombarding these surfaces with high energy ions which are accelerated across the high voltage gap between the cold-cathodes and their respective grids. Cold-cathodes 14 and 16 are preferably constructed from a non-magnetic, high conductivity, low work function and high melting point metal, particularly one of the refractory metals. Molybdenum or chromium is preferred, and stainless steel is also satisfactory.

An ionizable gas, such as hydrogen, helium, neon or argon, is introduced into the waveguide at a pressure in the approximate range of 1–100 mTorr, and preferably about 10–30 mTorr. This pressure range overcomes the problem of nonlinear instabilities taking energy out of the plasma waves and transferring it to the plasma particles at a very high rate. The relatively high pressure used in the invention is believed to significantly damp these instabilities, yielding high power levels and efficiencies. If the pressure is too high, however, the electron guns have difficulty in sustaining the relatively high voltages required.

If the electron-beam voltages are sustained at or above a threshold level, then the electron plasma waves driven by the high energy beams are non-resonant with the background plasma electrons, and intense electron plasma wavefields can be sustained in the discharge column. Significant electron plasma wave power may thus be coupled to electromagnetic radiation fields.

The waveguide housing is preferably closed at one end by a wall 26 in the general vicinity of the cathodes 14, 16. Electromagnetic radiation directed towards the right side of the waveguide is thus reflected off wall 26, reinforcing the output radiation travelling to the left.

The waveguide can be evacuated with a turbomolecular pump through an array of microperforations in the waveguide wall (not shown), and hydrogen gas introduced to raise the pressure within the waveguide to within the 10–30 mTorr range using a gas bottle reservoir and leak valve arrangement. In a preferred embodiment no pump is used, and instead the gas pressure is regulated by a $ZrH_2$ gas reservoir 28 attached to the outside of end wall 26. An internal coil heater 30 within the reservoir is heated by a current flowing along input/output lead wires 32, and emits hydrogen into the waveguide through perforations 34. Electromagnetic radiation is coupled out of the waveguide through a quartz window 36, which is attached to an output flange 38 on the waveguide and sealed by an O-ring 40. A horn antenna (not shown) may be positioned at the end of the waveguide to direct the radiation into a preferred region of space.

FIG. 3 shows another embodiment of the invention which is similar to the embodiment of FIG. 1, common elements being labelled with the same reference numerals. In this embodiment, cold-cathodes 14 and 16 communicate with separate discharge chambers 42 and 44 through grids 46 and 48, respectively. Wire anodes 50 and 52 extend into chambers 42 and 44 from vacuum feedthru bushings 54 and 56, respectively; the assemblies consisting of the negative high voltage cold-cathodes 14 and 16, their respective insulators 18 and 20, and the wire-anode discharge chambers 42 and 44 which supply the ion flux are WIP electron guns. These WIP electron guns form a plasma within their respective chambers directly, rather than having the plasma diffuse in from the waveguide. They provide an independently controllable source of ions, and thus enable variation of the electron beam currents independent of the plasma density inside the waveguide. This embodiment is generally preferable, since it provides a greater flexibility of operation.

A circuit for controlling the plasma discharge current of the WIP wire-anodes 4 within the waveguide, consists of a DC power supply 58 connected to an RC circuit comprising resistors R1, R2 and capacitor C1. The output is taken from R2 via a conventional crossatron switch 60 and delivered to the WIP electron gun anode wires 4. Switch 60 is toggled on and off to generate a chain of discharge pulses. The plasma discharge current can be varied by changing the resistance value of R2 and/or the output of power supply 58. A keep-alive circuit comprising a lower voltage power supply 62 in series with resistor R3 maintains a low current discharge (1 mA) to enable on-command, low-jitter ignition of the plasma. The circuit for controlling the plasma discharge current within WIP electron gun chambers 42 and 44 is substantially identical to the circuitry which controls the plasma discharge current within the waveguide, and is indicated by the same reference numerals.

A power supply circuit for driving the cold-cathodes 14, 16 is also shown in FIG. 3. It consists of a negative high voltage source 64, the optimum magnitude of which depends upon the waveguide dimensions connected to cold-cathodes 14 and 16 through resistors R4 and R5. A small capacitor C2 is tapped from the junction of R4 and R5 to ground.

In operation, the electron beams and the plasma discharge currents are generally turned on at the same time. The dependence of successful operation upon the attainment of threshold beam currents is illustrated in FIGS. 4(*a*) and 4(*b*). Operating with a waveguide dimension of 7.6 cm between cathodes and a threshold voltage of 15 kV (for the plasma wave tube of FIG. 3), the two beam currents were initially established at just over 2 amps, as illustrated in 4(*a*), and then allowed to gradually decay. The plasma discharge current was kept relatively stable at about 160 amps, as shown in 4(*b*). The Ka band emission at 35 GHz was measured over the range of beam currents. A significant emission was established at the initial beam current of just over 2 amps. Below this threshold, however, the emission rapidly diminished. The threshold voltage for the 7.6 cm dimension was found to be about 15 kV.

Figure 5:
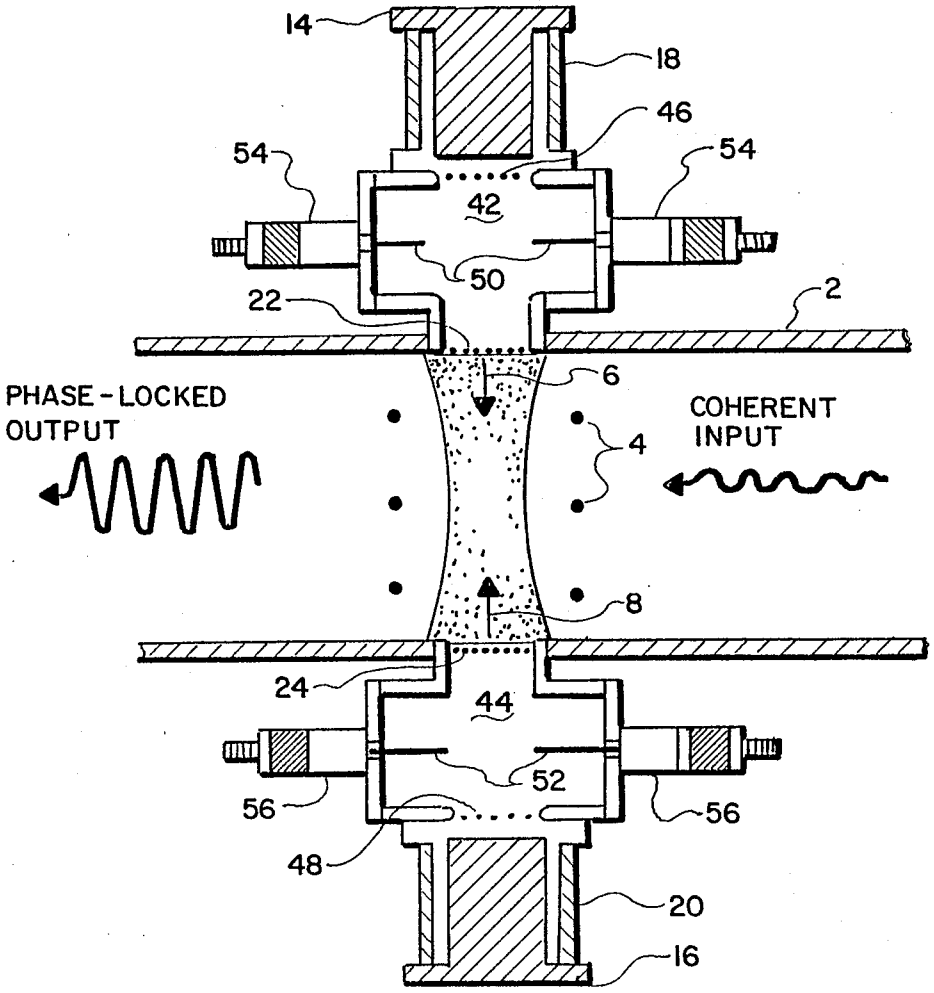
FIG. 5 is a sectional view of an embodiment of the plasma wave tube used as an amplifier.

FIG. 5 shows a variation in which the plasma wave tube is used as an amplifier. The structure is similar to that of FIG. 3, and the same reference numerals are used to indicate common elements. The difference is that end wall 26 of the FIG. 3 embodiment has been removed, and a coherent microwave signal directed into the housing from the former end wall location. In this manner a phase locked output can be produced to provide an amplifier function.

Figure 6:
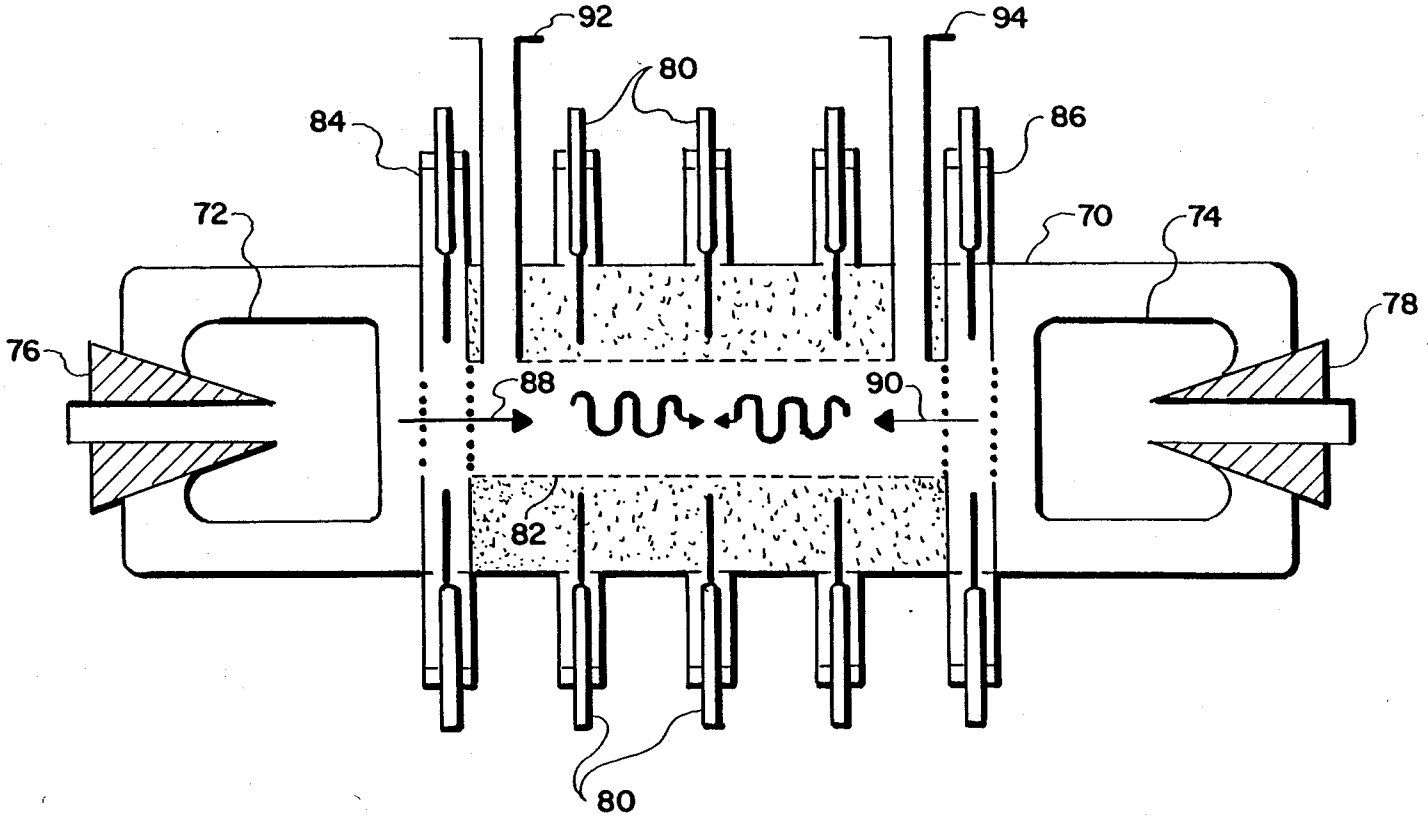
FIG. 6 is a sectional view of a circular waveguide embodiment of the invention.

Referring now to FIG. 6, another embodiment of the invention is shown which employs a waveguide housing 70 with a circular cross-section, i.e., a cylindrical waveguide. Electron beams are generated at opposite ends of the waveguide by cold-cathode secondary emission electron guns 72, 74, which are supplied through bushings 76, 78, respectively. A plasma is established around the periphery of the waveguide by wire-anode discharge assembly 80, and diffuses through perforations in a cylindrical grid 82 into the interior waveguide region. A plasma is also established adjacent cold-cathodes 72 and 74 by wire-anode discharge 84 and 86, respectively, so that counterpropagating electron beams 88 and 90 are directed into the waveguide plasma to drive counterpropagating electron plasma waves, and couple nonlinearly with these waves to generate an electromagnetic waveguide mode at twice the plasma frequency. The electromagnetic wave is then coupled out through output waveguides 92 and 94 at each end of the cylindrical waveguide.

Figure 7:
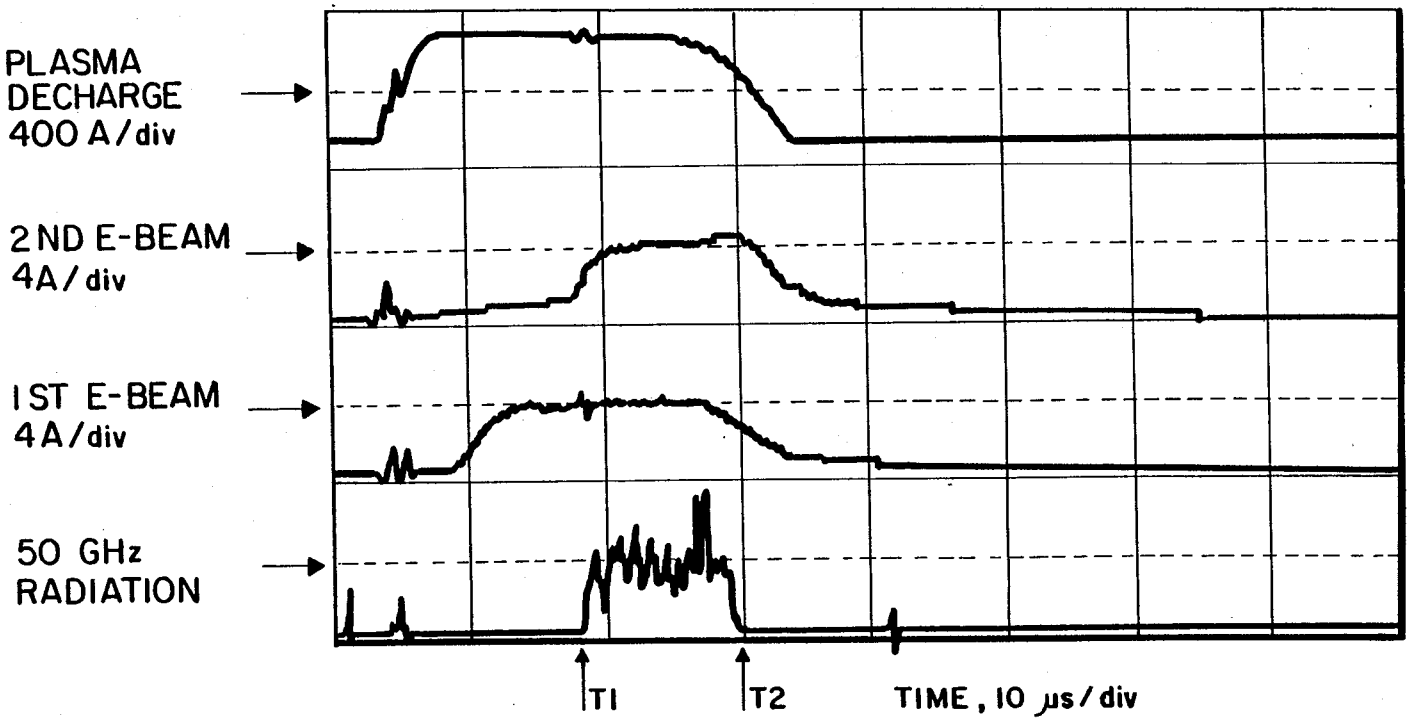
FIG. 7 is a graph illustrating the dependence of emitted electromagnetic radiation upon the overlap of a pair of electron beams within the plasma.

The presence of a pair of counterpropagating electron beams has been found to be an essential element of the invention. The necessity for simultaneous beam injection was demonstrated by delaying the injection of one beam relative to the other for the embodiment of FIG. 6; the operating conditions and results are shown in FIG. 7. With a generally constant plasma discharge current, no output radiation (at 50 GHz) was generated when only the first beam was applied. However, output radiation was rapidly established beginning at time T1, when the second beam was applied. The first beam was then gradually turned off, and the output radiation terminated during this transition.

Figure 8:
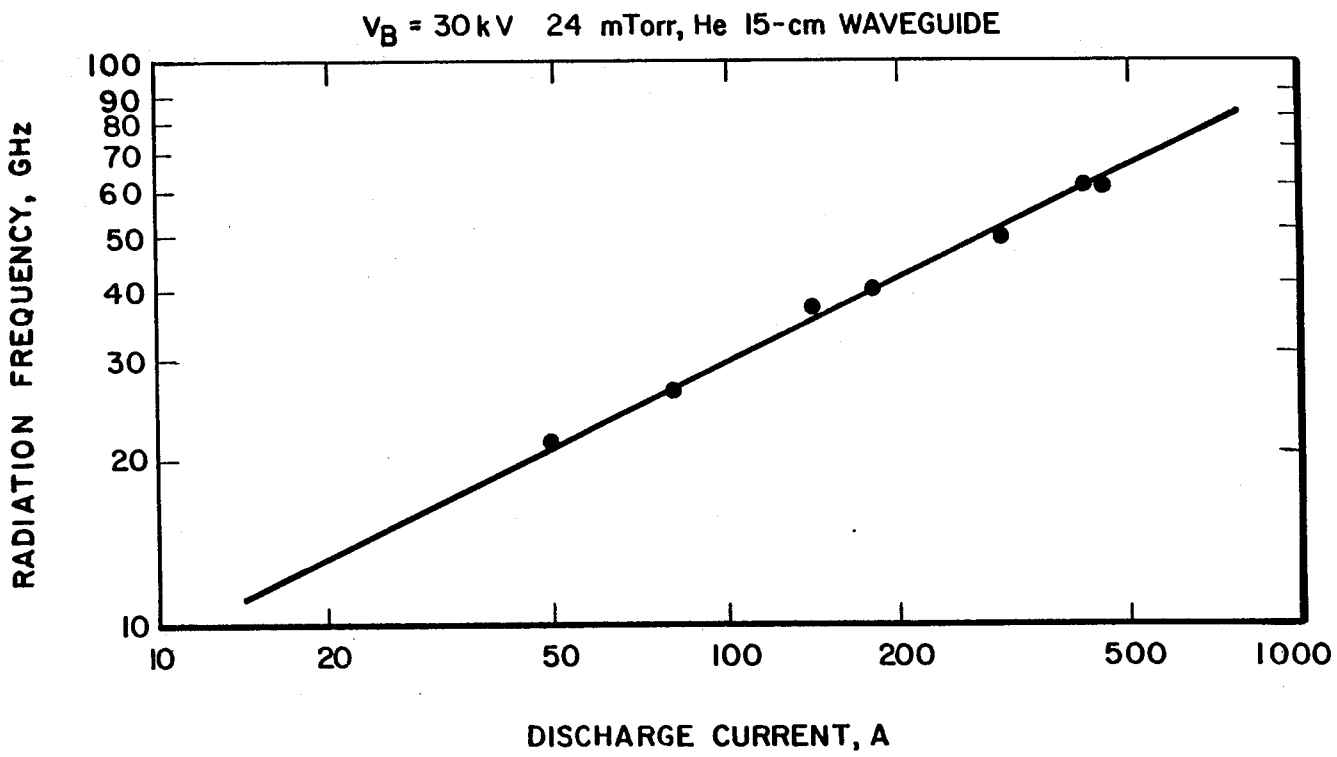
FIG. 8 is a graph illustrating the dependence of output frequency upon the plasma discharge current.

FIG. 8 illustrates the manner in which the output radiation frequency can be controlled by controlling the plasma discharge current from the wire-anode discharge. Readings were taken with beam voltages of 30 kV, with a waveguide pressure of 24 mTorr and 15 cm between beam sources. Under these conditions, the radiation frequency was observed to scale as the square root of the discharge current.

The scaling of mm-wave (30 GHz) power with electron beam voltage and current is illustrated in FIGS. 9 and 10, respectively; the observations were made with a waveguide as in FIG. 6, 15 cm long. FIG. 9 illustrates the output power scaling with equal beam voltages for beam currents of 3.5 and 5.3 amps. Maximum power outputs were observed in the vicinity of 30 kV, with the power diminishing significantly at both higher and lower voltages. This phenomenon may be explained by considering the electron plasma wave (EPW) profile excited by the beams. The main requirement for high power emission is that the EPWs overlap spatially so they can interact to generate the mm-wave radiation. In general, the EPW amplitude will grow, saturate, and then decay along the beam direction. When the beam voltage is too low, the EPWs saturate and decay near the ends of the waveguide before they interact. When the voltage is too high, the EPWs require a long distance before they can grow to large amplitude. The radiation generated under either of these two conditions is less than that which would be obtained if the optimum beam voltage were used. At the optimum voltage the EPWs overlap near the waveguide mid-plane where they have the largest amplitude. In general, the beam voltages should be restricted to a level no greater than 50 kV.

Output radiation power scaling with total beam current (the sum of the actual injected beam currents) is given for one demonstration in FIG. 10. Three distinct regimes were observed. First, there is a sharp threshold current below which no detectable power is observed. Second, once the threshold current is reached (about 2 [illegible] amps in this case), the power [illegible] order [illegible] which is approximately proportional to the current raised to the sixth power.

The current threshold effect is believed to be controlled by the electron beam dynamics. At total beam current values below 3 amps for the conditions stated in FIG. 10, the current in each beam is below the Bennett-pinch current of 1.5 amps. In this regime the beam channel is broad, the beam density is low, the beam-plasma interaction is weak, and the mm-wave power is below the detection threshold. When the current in each beam reaches 1.5 amps (3 amps total), however, the beam rapidly collapses, the beam density increases sharply, the beam-plasma instability growth rate increases, and the mm-wave radiation suddenly rises. Once each beam becomes fully pinched with the Bennett equilibrium profile, the power rises more slowly and an $I^6$ scaling for the beam current is observed up to about 5 amps.

A significant improvement in efficiency, resulting in efficiencies on the order of $10^{-3}$–$10^{-2}$ and above, has been observed. This enhanced efficiency is coupled with a broad frequency and output power tunability, compact packaging, low voltage operation and simple, rugged mechanical design. The use of two electron beams with a separate plasma formation mechanism makes it feasible to have a longer interaction length between the beams and the plasma, and therefore a higher efficiency, than in the related patent application referred to above.

Since numerous variations and alternate embodiments will occur to those skilled in the art, it is intended that the invention be limited only in terms of the appended claims.

We claim:

1. An improved plasma wave tube, comprising:

a waveguide housing having first and second ends, means for introducing an ionizable gas into said housing, a plurality of wire anodes extending into said waveguide housing to form a discharge plasma from ionizable gas therein, and electron beam generating means mounted in alignment with each other on opposite faces of the waveguide housing for generating a pair of counterpropagating electron beams through the plasma within said housing at a sufficient voltage, relative to the waveguide housing, to establish a pair of electrostatic plasma waves which mutually couple to emit electromagnetic radiation within the waveguide housing, the eletrostatic plasma wave propagating in a direction perpendicular to the length of the waveguide housing, and an output window, at the first end of the waveguide housing, for coupling the electromagnetic radiation out of the waveguide housing,k

2. The plasma wave tube of claim 1, further comprising means for controlling the plasma density, and thereby the frequency of the emitted electromagnetic radiation, by controlling the discharge current from said wire anodes independent of said electron beam generating means.

3. The plasma wave tube of claim 1, further comprising means for controlling the power of the emitted electromagnetic radiation by controlling the voltage levels of said electr[illegible]

m 1, further compris-
ower of the emitted
trolling the current

5. The improved plasma wave tube of claim 1, each said electron beam generating means comprising a cold-cathode wire ion plasma discharge means.

6. The plasma wave tube of claim 1, said electron beam generating means generating their respective beams at a voltage relative to the waveguide housing within the approximate range of 4–50 kV.

7. The plasma wave tube of claim 6, said electron beam generating means generating their respective beams with current densities of at least about 1 amp/cm$^2$.

8. The plasma wave tube of claim 1, said gas introducing means introducing said gas into said waveguide housing at a pressure within the approximate range of 1–100 mTorr.

9. The plasma wave tube of claim 8, said gas being introduced into said waveguide housing at a pressure within the approximate range of 10–30 mTorr.

10. An improved plasma wave tube of claim 1, wherein the waveguide housing is closed at the second end such that the electromagnetic radiation directed towards the second end is reflected towards the output window 11. The improved plasma wave tube of claim 5 wherein the cold-cathode wire ion plasma discharge means comprises:

a cold cathode;

a discharge chamber in communication with the cold cathode;

a grid between the cold cathode and the discharge chamber, and wire anodes extending into the discharge chamber to generate a wire-anode discharge.

12. The improved plasma wave tube of claim 11 wherein the waveguide housing is closed at the second end such that the electromagnetic radiation directed towards the second end is reflected towards the output window.

13. The improved plasma wave tube of claim 11 wherein a coherent microwave signal is directed into the waveguide housing from the second end such that a phase locked output is generated.

14. An improved plasma wave tube, comprising:

a rectangular waveguide housing having first and second ends, means for introducing an ionizable gas into said housing, at least one wire anode extending within said housing for forming a plasma by ionizing gas introduced into the housing, and a pair of contradirected electron beam generators disposed on opposite sides of said waveguide housing for generating a pair of counterpropagating electron beams through said plasma, said electron beam generators generating their respective electron beams at a sufficient distance, to establish a pair of electrostatic plasma waves which mutually couple to emit electromagnetic radiation within the waveguide housing generally transverse to the electron beams, and propagating along the length of the waveguide housing, and an output window at the first end of the waveguide housing for coupling the electromagnetic radiation out of the waveguide housing.

15. The plasma wave tube of claim 14, wherein said electron beam generators are mutually spaced apart by about 7–8 cm, and generate their respective electron beams at voltages at least equal to a threshold voltage of about 15 kV relative to the waveguide housing.

16. The plasma wave tube of claim 14, wherein said electron beam generators are mutually spaced apart by about 1–1.5 cm, and generate their respective electron beams at voltages at least equal to a threshold voltage of about 4 kV relative to the waveguide housing.

17. The plasma wave tube of claim 14, said electron beam generating means comprising a cold-cathode wire ion plasma discharge means for each beam.

18. The plasma wave tube of claim 17, said electron beam generating means each comprising a chamber communicating with the interior of said waveguide housing, a cold-cathode extending into said chamber, and means for applying a voltage signal to said cold-cathodes, said chamber enabling a flow of plasma the waveguide stimulate electron emission from the cold-cathode.

19. The plasma wave tube of claim 17, said electron beam generating means each comprising a chamber communicating with the interior of said waveguide housing, a cold-cathode extending into said chamber, means for applying a voltage signal to said cold-cathode, and at least one wire anode extending into said chamber for ionizing gas in the vicinity of said cold-cathode.

20. The plasma wave tube of claim 14, further comprising means for controlling the plasma density within the waveguide housing, and thereby the frequency of the emitted electromagnetic radiation, by controlling the rate of ionization by said plasma forming means.

21. The plasma wave tube of claim 14, further comprising means for controlling the power of the emitted electromagnetic radiation by controlling the voltage levels of said electron beams.

22. The plasma wave tube of claim 14, further comprising means for controlling the power of the emitted electromagnetic radiation by controlling the current levels of said electron beams.

23. The plasma wave tube of claim 14, said electron beam generating means generating their respective beams at a voltage relative to the waveguide housing within the approximate range of 4–50 kV.

24. The plasma wave tube of claim 23, said electron beam generating means generating their respective beams with current densities of at least about 1 amp/cm$^2$.

25. The plasma wave tube of claim 14, said gas introducing means introducing said gas into said waveguide housing at a pressure within the approximate range of 1–100 mTorr.

26. The plasma wave tube of claim 25, said gas being introduced into said waveguide housing at a pressure within the approximate range of 10–30 mTorr.

* * * * *

UNITED STATES PATENT AND TRADEMARK OFFICE

CERTIFICATE OF CORRECTION

PATENT NO. : 4,916,361

DATED : APRIL 10, 1990

INVENTOR(S) : ROBERT W. SCHUMACHER, et al.

It is certified that error appears in the above-indentified patent and that said Letters Patent is hereby corrected as shown below:

Title Page: in OTHER PUBLICATIONS, line 1, delete "Sealing" and insert --Scaling--.

Signed and Sealed this

Fourteenth Day of December, 1993

*Attest:*

Bruce Lehman

BRUCE LEHMAN

*Attesting Officer*

*Commissioner of Patents and Trademarks*